US005716242A

United States Patent [19]

Myer

[11] Patent Number: 5,716,242

[45] Date of Patent: Feb. 10, 1998

[54] INSULATION DISPLACEMENT CONTACT WITH RETENTION FEATURE

[75] Inventor: John M. Myer, Millersville, Pa.

[73] Assignee: The Whitaker Corporation, Wilmington, Del.

[21] Appl. No.: 805,020

[22] Filed: Feb. 21, 1997

Related U.S. Application Data

[63] Continuation of Ser. No. 426,328, Apr. 21, 1995, abandoned.

[51] Int. Cl.[6] ..... H01R 13/432

[52] U.S. Cl. ..... 439/748

[58] Field of Search ..... 439/746–749, 439/456, 459, 460, 467, 417, 404, 405, 845, 849, 850

[56] References Cited

U.S. PATENT DOCUMENTS

| | | | |
|---|---|---|---|
| 3,513,438 | 5/1970 | Henschen et al. | 439/746 |
| 3,656,093 | 4/1972 | Kinkaid | 339/217 S |
| 3,792,420 | 2/1974 | Könnemann et al. | 339/258 R |
| 3,963,302 | 6/1976 | Gourley | 339/217 S |
| 4,030,804 | 6/1977 | Enomoto | 339/258 S |
| 4,046,450 | 9/1977 | Yurtin | 439/746 |
| 4,252,399 | 2/1981 | Bäuerle | 339/256 R |
| 4,344,665 | 8/1982 | Racilla et al. | 339/99 R |
| 4,493,523 | 1/1985 | Leong et al. | 339/105 |
| 4,696,530 | 9/1987 | Vandame | 439/849 |
| 4,784,623 | 11/1988 | Beck, Jr. | 439/872 |
| 4,915,645 | 4/1990 | Konnemann et al. | 439/417 |
| 4,992,056 | 2/1991 | Douty et al. | 439/83 |
| 5,362,260 | 11/1994 | Peloza | 439/746 |
| 5,427,544 | 6/1995 | Okabe | 439/397 |
| 5,624,273 | 4/1997 | Myer | 439/748 |

FOREIGN PATENT DOCUMENTS

| | | |
|---|---|---|
| 86 15 615 | 9/1986 | European Pat. Off. . |
| 0 433 625 | 6/1991 | European Pat. Off. . |
| 8608199 U | 6/1986 | Germany . |
| 6-111 860 | 4/1994 | Japan . |

*Primary Examiner*—Gary F. Paumen

[57] ABSTRACT

An electrical contact (10) for use with an electrical contact assembly (80) includes an electrical contact (10) with a contact section (20), IDC section (30) and a relief section (40). The electrical contact (10) is disposed in a dielectric housing (60) having a rotatable stuffer member (70) for pushing a wire (12) into electrical engagement with IDC section (30). Force vector F is a separating force which will cause the strain relief section (40) to deflect and thereby more firmly grip the wire (12) between a retention gripping portion (46) and a retention surface (76) of stuffer (70). Any separating force will cause stop member (27) of contact section (20) to engage a shoulder (62) of housing (60) thereby causing a shearing action as an edge (**28*b*) engages the stop member (27**).

20 Claims, 4 Drawing Sheets

INSULATION DISPLACEMENT CONTACT WITH RETENTION FEATURE

This application is a Continuation of application Ser. No. 08/426,328 filed Apr. 21, 1995, now abandoned.

The present invention relates to an electrical connector comprising a dielectric housing and an insulation displacement (IDC) contact with a retention feature. More particularly, the present invention relates to the advantageous configuration of the retention feature, which configuration provides ease of assembly to the housing and an increased retention capability with respect to the electrical contact after it has been loaded into the housing.

BACKGROUND OF THE INVENTION

A known electrical connector employing a contact retention feature is shown in U.S. Pat. No. 4,992,056. This known electrical connector is mounted on a printed circuit board comprising a housing with through passages each receiving an electrical terminal having a transverse lance with a free end lodged in a recess in a sidewall of the housing, and the contact includes solder tails for soldering to a printed circuit board. This known connector provides an advantageous way of connecting an electrical contact to a housing; however, the free end of the transverse lance is positioned to be plastically deformed or otherwise fail in its retention function due to the possibility of a sidewall of the terminal engaging and thereby over-stressing the transverse lance when an axial pulling force is applied to the electrical contact. Moreover, the electrical terminal is fixed in place within the housing by virtue of the transverse lance free end because the arrangement does not provide for a readily removable contact in that the free end will be jammed against the inner surface of the housing recess in which it resides.

Additionally, since the transverse lance is disposed at a generally acute angle with respect to the contact insertion direction, it is very possible that the free end of the lance will not properly register with the housing recess, thereby resulting in the contact potentially being removed from the housing upon application of a pulling force. Lastly, it is possible that the lance can be forcibly removed from the recess by action of a pulling force because a further edge of the contact will engage the lance, pivot the lance about its only bend and thereby remove the free end of the lance by pushing it out of the recess and removing the contact from the housing. Since the lance is disposed at an angle relative to the housing recess, the free end of the lance can break or otherwise shear off a chunk of the housing recess, thereby allowing removal of the contact from the housing.

Another known electrical connector with a retention feature is disclosed in U.S. Pat. No. 4,252,399. This known electrical contact is designed for use with an electrical connector having a resilient tab for retaining the contact in the connector housing. The tab is attached to a central portion of the contact and extends diagonally, like the prior art reference noted above, through the center of the element at a acute angle relative to the longitudinal axis of the contact. A free end of the tab extends beyond the contact for engaging a shoulder of the housing after the contact is inserted through a passageway in the housing.

The free end of the tab may be deflected inwardly by means of a pin-like tool to disengage the tab from the shoulder and allow removal of the contact from the housing. A stop surface in the central portion of the contact prevents deflection of the tab beyond its elastica limit thereby preventing damage to the terminal contact. This known electrical contact provides an advantageous way of latching a contact to a connector housing; however, the latching surface area of the electrical contact is limited by the thickness of the free end of the tab and, therefore, the contact is likely to be pulled away from the electrical connector housing upon application of a pulling force. Moreover, no portion of the electrical contact or connector housing is arranged to buttress the tab against buckling or bending, which potentially would allow a pulling force to loosen and remove the contact from the electrical connector housing. Additionally, it is entirely possible that a strong pulling force will cause the free end of the tab and its associated sharp corners to shear off a chunk of the dielectric housing, thereby allowing removal of the contact from the housing.

Another known electrical connector is disclosed in U.S. Pat. No. 4,784,623. A wall of the electrical contact disclosed therein includes an upper resilient arm which is separated from a base of the contact and is formed outwardly to define a retention lance which engages a portion of the housing. This known electrical contact provides a way of retaining an electrical contact in a electrical connector housing; however, the retention lance is disposed in an arcuate shape or acute angle relative to the contact insertion direction and is thereby liable to be bent or otherwise deformed during application of a pulling force to the wire connected to the electrical contact. As in the prior art noted above, the contact surface area between the retention lance and the electrical connector housing is limited by the thickness of the retention lance. Therefore, the electrical connector housing can be broken in the area where the retention lance engages the housing by virtue of the sharp corners and sharp end of the retention lance. Moreover, there is no part of the housing or contact itself which buttresses the retention lance against deformation or breakage.

The present invention overcomes the deficiencies in the prior electrical contacts by providing a retention feature which distributes stress along a wide surface of the aperture in which it resides thereby avoiding breakage or deformation of the housing insulation. The retention feature of the present invention also provides for a true shearing action which resists high magnitude separating forces applied to the contact, and yet is removable from the electrical connector housing by using a simple tool, for example, a prong or screwdriver.

SUMMARY OF THE INVENTION

The present invention provides electrical contact for termination with an electrical wire and for insertion into a connector housing which comprises: an integral contact section having a stop member for engaging the housing; an integral contact termination section for termination with the wire; and an integral strain relief section for engaging the wire and preventing the transmission of tensile forces acting on the wire to the strain relief section.

DETAILED DESCRIPTION OF THE INVENTION

Figure 1:
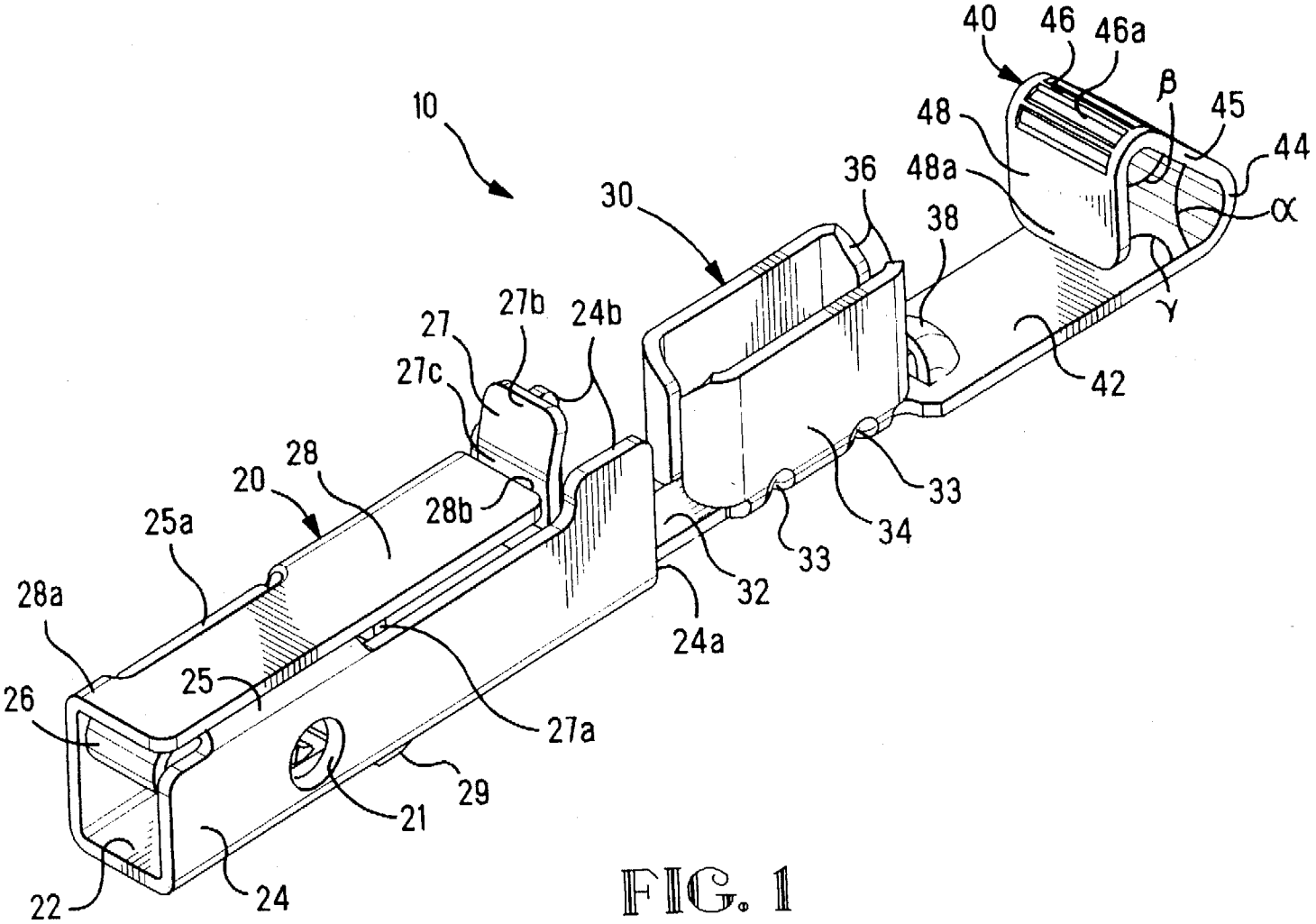
FIG. 1 shows an isometric view of the electrical contact according to the present invention.

FIG. 1 shows an electrical contact 10 having a contact section 20, an IDC section 30, and a strain relief section 40. Contact section 20 includes: a base portion 22; walls 24 having edges 24*a* and shoulders 24*b* with one wall 24 having a hole 21 formed therein; an inner top portion 25 with a locking tab 25*a*; a resilient leg 26 for engaging a further electrical component (e.g. a tab or pin contact); a stop member 27 with bends 27*a*, a stop leg 27*b*, and a plate 27*c*; an edge 28*b* and an outer top portion 28 having a tab aperture 28*a* for receiving locking tab 25*a*; and a resilient off-set portion 29 formed on the bottom of contact section 20 for connection to an electrical connector housing. Offset portion 29 is formed adjacent to a platform 29*a*, which platform advantageously helps to control the contact forces generated between leg 26 and platform 29*a* when a tab or pin has been inserted into electrical contact 10.

Still referring to FIG. 1, IDC section 30 (IDC) includes a base portion 32 with upstanding walls 34 formed thereon, which walls include IDC blades 36 for receiving, stripping the insulation from a prtion of, and terminating an electrical conductor. Stiffening gussets 33 are formed between base section 32 and walls 34 for increasing the contact force generated by the walls 34. Additionally, IDC section 30 includes a boot 38 for uplifting and supporting the wire to be terminated to a more centralized and contact force maintaining location between blades 36.

Strain relief section 40 includes a base portion 42 with a bend 44 extending therefrom. Bend 44 is connected to an intermediate portion 45, and intermediate portion 45 is connected to a generally arcuate wire gripping portion 46. The radius of bend 44 is advantageously greater than the radius of bend 46 for flexibility of intermediate portion 45 and portion 46 about bend 44, but it is contemplated that other radii may be used. Wire gripping portion 46 includes serrations 46*a* for engaging a wire, as will be described below. Strain relief section 40 further includes an overstress leg 48 having an edge 48*a* for engagement with base portion 42 when and if edge 48*a* is deflected that far. Strain relief section 40 comprises three angles: angle α, defined by base portion 42 and intermediate portion 45; angle β, defined by intermediate portion 45 and overstress leg 48; and angle γ, defined by base portion 42 and overstress leg 48.

Figure 2:
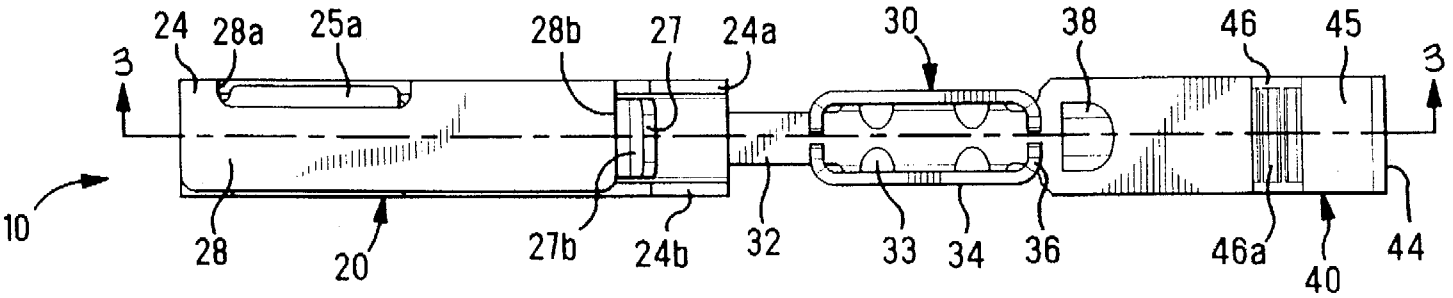
FIG. 2 shows a top view of the electrical contact of FIG. 1.

Now referring to FIG. 2, a top view of the electrical contact 10 of FIG. 1 is shown. This view shows locking tab 25*a* of inner top portion 25 protruding through tab aperture 28*a* of outer top portion 28 thereby effectively interlocking inner top portion 25 to outer top portion 28. Additionally, boot 38 is shown laterally aligned with blades 36 of IDC section 30 for uplifting a wire to be terminated in the IDC section 30.

Figure 3:
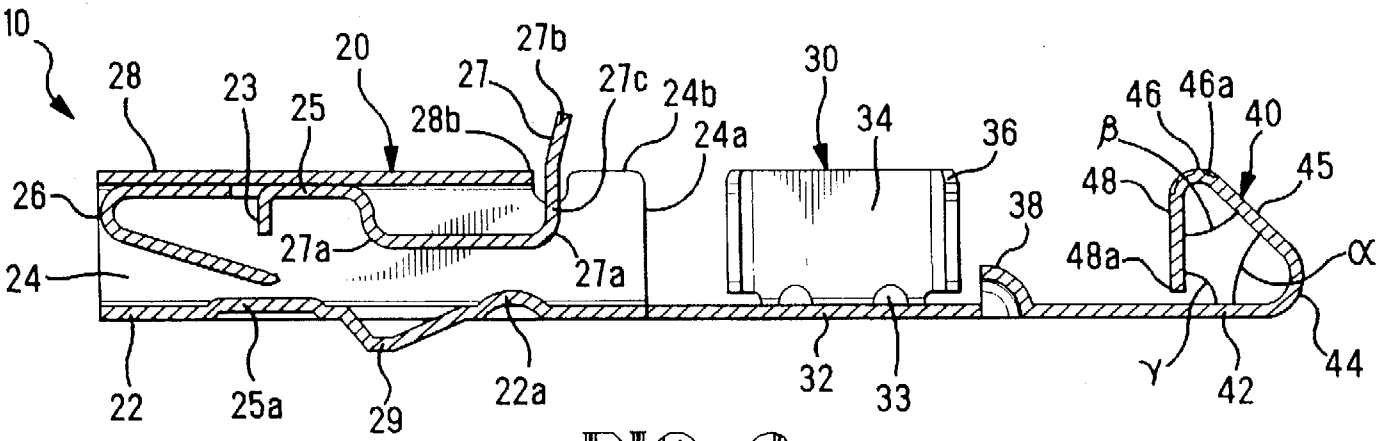
FIG. 3 shows a side cross sectional view of the electrical contact of FIG. 2 taken along line 3—3.

Referring to FIG. 3, a cross sectional view of the electrical contact of FIG. 1 taken along line 3—3 of FIG. 2 is shown. FIG. 3 provides a good view of overstress stop 23 of contact section 20, which stop is aligned for engagement with resilient leg 26 when a tab or pin contact is inserted into the contact section 20. Stop 23 will, if necessary, engage the end of resilient leg 26 thereby preventing overstress of the resilient leg 26. FIG. 3 also shows: bends 27*a* of stop member 27; plate 27*c* aligned for engagement with edge 28*b* of outer top portion 28, as will be further described below; offset portion 29 which is formed into base portion 22; edges 24*a* of wall 24; and angles α, β, and γ.

Figure 4:
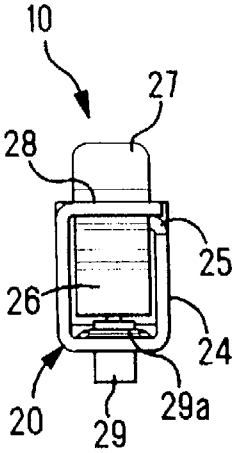
FIG. 4 shows a front elevational view of the electrical contact of FIG. 1.

Referring to FIG. 4, a front elevational view of the contact 10 is shown depicting the various parts of contact section 20.

Figure 5:
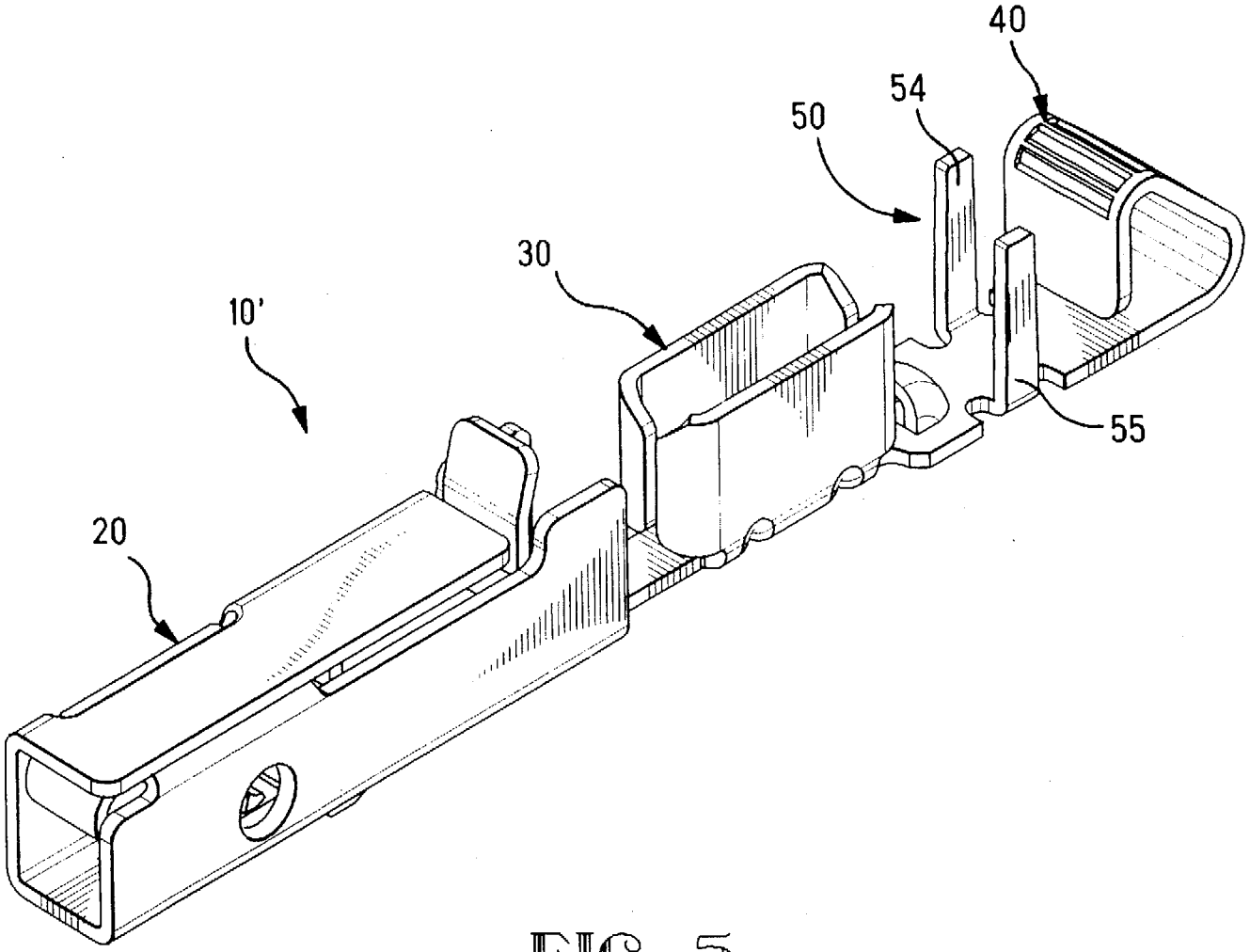
FIG. 5 shows an isometric view of a second embodiment of the present invention.

FIG. 5 shows a second embodiment 10' of the present invention. Electrical contact 10' includes a contact section 20, an IDC section 30, and a strain relief section 40, which sections are similar or identical to that of electrical contact 10 as described above. However, electrical contact 10' includes a "wrap around" strain relief member 50 comprising gripping tabs 54 and 55. Tabs 54 and 55 are crimpable tabs adapted for crimpable engagement with the insulation of a wire to be terminated in the electrical contact 10'.

Figure 6:
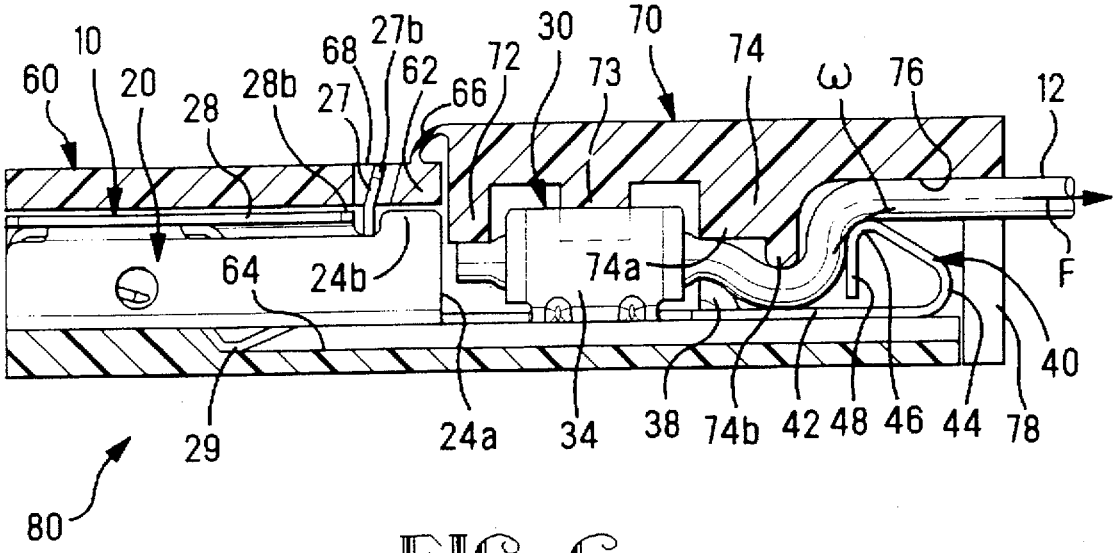
FIG. 6 shows a cross sectional view of an electrical connector assembly according to the present invention.

Now referring to FIG. 6, an electrical connector assembly 80 is shown which includes a housing 60, a stuffer 70, and the electrical contact 10 having a wire terminated therein disposed within the housing 60 and stuffer 70. Housing 60 includes a recess for receiving contact 10 and a shoulder 62 disposed adjacent to stop member 27 of contact section 20. A recess 64 is formed in housing 60 for accommodating offset portion 29 of contact section 20. Stuffer 70 is hingeably attached to housing 60 by hinge 66, but this is not an absolute requirement as it is contemplated that stuffer 70 can be formed as wholly separate from housing 60. Stuffer 70 includes a front ram 72, a rear ram 74 with edge 74*a* and nose 74*b*, a frictional retention surface 76, and a wire guide 78.

Referring to the embodiment of FIG. 6, assembly of the electrical contact assembly 10 is accomplished by inserting electrical contact 10 into housing 60 so that offset portion 29 of contact section 20 registers with recess 64, and stop leg 27 is located adjacent to shoulder 62. A wire 12 is then placed over the IDC walls 34 in axial alignment with blades 36 of IDC section 30. At this time, cover 70 is rotated about hinge 66, and front ram 72 and rear ram 74 pressingly engage wire 12, thereby stuffing wire 12 into electrical engagement with IDC section 30 between walls 34 and blades 36 thereof. It is important to note, however, that front ram 72 engages a front surface of wire 12, and edge 74*a* of rear ram 74 engages an axially opposing surface of wire 12. Moreover, nose 74*b*, which downwardly protrudes from rear ram 74, pushes a respective portion of wire 12 into engagement base portion 42. Boot 38 maintains a centerline of wire 12 relatively higher than a centerline of the respective portion of wire 12 adjacent to nose 74*b*. It is also important to note that wire 12 is poised for frictional engagement with serrations 46*a* of wire gripping portion 46 and overstress leg 48 of strain relief section 40, and is arranged for frictional engagement with retention surface 76 of stuffer 70. Thus, wire 12 comprises a series of contorted bends, and thereby is conformed to a torturous path within assembly 80.

As shown in the right hand side of FIG. 6 a tensile force vector F, when it is applied to wire 12, will cause strain relief section 40 to deflect, resulting in an increase in angle α (see FIG. 3), and thereby defining an eccentric arc ω as shown in the drawing. As wire gripping portion 46 of strain relief section 40 is moved along this eccentric arc, the effective distance between wire gripping portion 46 and retention section surface 76 will decrease. The decrease in distance will result in a squeezing effect, i.e. a greater magnitude in gripping force will be applied to the wire 12 by retention surface 76 of stuffer 70 and wire gripping portion 46. Thus the tensile force F acting on the wire terminated in the IDC is converted to use in increasing the frictional retention forces which tend to resist the tensile forces, thereby creating a "Chinese finger" effect, and which conversion prevents the transmission of tensile forces to the contact termination section 30.

The tensile force transmitted to wire 12 by force vector F will cause a force to be applied generally to contact 10. However, bend 44 of strain relief section 40 will not abut the housing 60 but, rather, the force transmitted to electrical contact 10 will be borne by edges 24*a* and shoulders 24*b* of walls 24 of contact section 20, which edges and shoulders engage a portion of front ram 72 of stuffer 70, and bend 44 may bear against wire guide 78. As wire 12 is more firmly gripped between wire gripping portion 46 and retention surface 76, no forces will be transmitted to the IDC section 30, thereby advantageously preserving the electrical continuity between walls 34 of IDC section 30 and the conductive core inside wire 12.

Moreover, any force vector F which tends to separate the contact 10 from housing 60 will result in a shearing force being applied to stop member 27. Force vector F will tend to shift electrical contact 10 relatively to the right as shown in FIG. 6 (with the housing 60 remaining stationery). Stop leg 27*b* of stop member 27 will thus engage shoulder 62 of housing 60. As this occurs, stop member 27 will be resiliently deflected towards and will forcibly engage edge 28*b* of outer top portion 28 of contact section 20. Thus a shearing force is imparted to stop member 27 by engagement of edge 28*b* with stop member 27 on a lower side, and the shoulder 62 of housing 60 engaging stop member 27 on an upper side. Since this shearing force is resisted by generally the full thickness of stop member 27, electrical contact 10 is capable of withstanding a great deal of force tending to separate it from housing 60.

Figure 7:
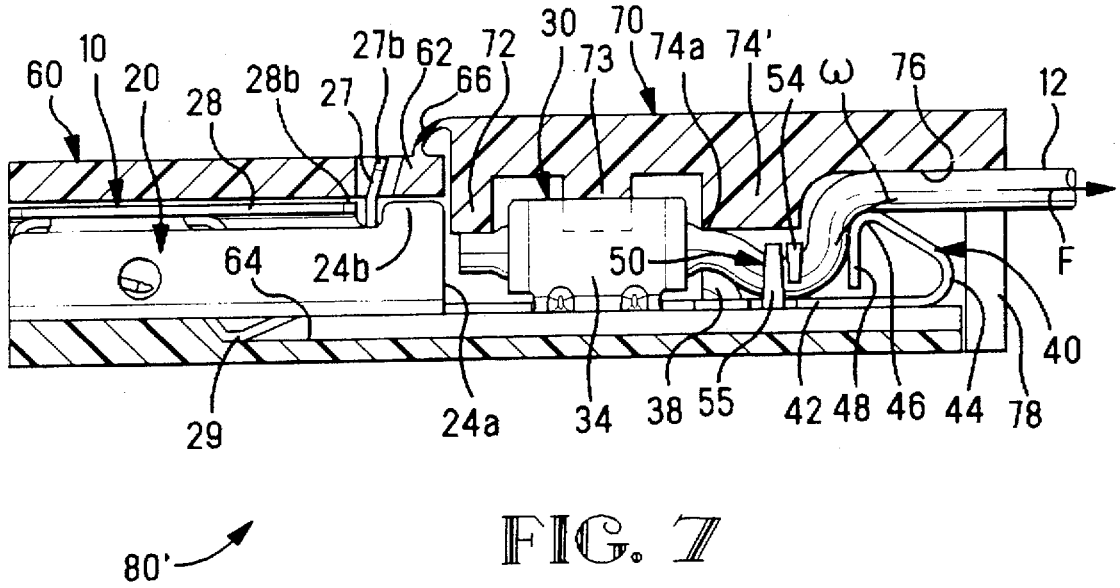
FIG. 7 shows a cross sectional view of a second embodiment of an electrical connector assembly according to the present invention.

Referring now to FIG. 7, electrical connector assembly 80' will be described. Assembly 80' essentially incorporates electrical contact 10' into housing 60 with a stuffer 70 similar to the embodiment of FIG. 6. However, the rear ram 74 has been modified to a rear ram 74' with a truncated lower surface. Truncating the lower surface of rear ram 74' creates space for wrap around strain relief member 50 with gripping tabs 54 and 55 for firmly capturing the wire 12 thereby obviating the need for a further gripping portion such as, for example, the nose 74*b* of rear ram 74 of the embodiment of FIG. 6.

Thus, while preferred embodiments of the invention have been disclosed, it is to be understood that the invention is not to be strictly limited to such embodiments but may be otherwise variously embodied and practiced within the scope of the appended claims. For example, although stuffer 70 is shown hinged to housing 60 by a hinge 66, it is contemplated that stuffer 70 can be a wholly separate member. Moreover, although receptacle contacts 10 and 10' have been disclosed, it is contemplated that the present invention can be adapted for use with any IDC contact including pin, tab, or other interconnection systems. Additionally, it is contemplated that boot 38 can take the form of a mere tab. It is also contemplated that the housing 60 and stuffer 70 can be modified to include a plurality of electrical contacts 10 and/or 10' for mass termination of a plurality of wires 12.

The ideal engineering materials for the electrical contacts disclosed above will comprise metals having high strength, high conductivity, and a low cost. For example, such metals as copper, brass, bronze, beryllium copper, copper alloys, steel, nickel, aluminum, and zinc. Additionally, it is preferred that the above described contacts comprise a stamped and formed contact. However, other methods may be used to form the contact as well. It is further desired that the electrical contacts will be coated or plated for corrosion resistance. For example, a coating comprising tin, tin low lead, tin lead, nickel, gold, silver, copper, zinc, or palladium. It is further contemplated that the electrical contacts will be plated by, for example, an electro-deposition process. The housing 60 and stuffer 70 can be formed of any suitable dielectric plastic or other dielectric material.

I claim:

1. An electrical contact for termination with an electrical wire and for insertion into a connector housing, the contact having a main axis, comprising:

an integral contact section having a stop member for engaging said housing, the contact section having a top wall extending in the same direction as the main axis of the contact, an inner top wall extending along the inner side of the top wall, the inner top wall having said stop member extending therefrom, said stop member being a tab extending substantially perpendicular to the top wall, the tab passing from an interior of the contact section past the plane of the top wall, whereby when forces are exerted against the tab, the tab engages the top wall such that substantially all of the forces against the tab are sheer forces;

an integral contact termination section for termination with said wire; and an integral strain relief section for engaging said wire and preventing the transmission of tensile forces acting on said wire to said contact termination section.

2. The electrical contact of claim 1, wherein said stop member comprises a pair of bends for allowing resilient deflection of said stop member.

3. The electrical contact of claim 1, wherein said stop member comprises a stop leg, and said contact section comprises an edge for engaging said stop member.

4. The electrical contact of claim 3, wherein said stop leg is resiliently deflectable so that a force acting on said stop leg and directed toward said contact section edge will cause said stop member to deflect towards said edge.

5. The electrical contact of claim 1, wherein said contact section comprises an overstress tab for engaging a resilient leg formed on said contact section.

6. The electrical contact of claim 1, wherein said contact section includes a platform formed on a lower wall thereof, and a resilient leg formed on a top wall thereof, said resilient leg and said platform are adapted to receive a further electrical contact therebetween.

7. The electrical contact of claim 1, wherein said contact section comprises a pair of side walls, said side walls comprise shoulders for engaging said connector housing in response to said tensile forces acting on said wire.

8. The electrical contact of claim 7, wherein said stop member is located between said shoulders.

9. The electrical contact of claim 1, wherein said contact termination section includes a pair of insulation displacement blades.

10. The electrical contact of claim 9, wherein a boot is formed on said contact termination section for guiding said wire to a position between said blades.

11. The electrical contact of claim 1, wherein said contact termination section is located between said contact section and said strain relief section.

12. The electrical contact of claim 1, wherein said stop member is located toward said contact termination section.

13. An electrical connector assembly for terminating at least one electrical wire, comprising:

a dielectric housing with a recess for receiving an electrical contact therein;

an electrical contact disposed in said recess, the contact having a main axis and comprising an integral contact section having a stop member for engaging said housing, the contact section having a top wall extending in the same direction as the main axis of the contact, an inner top wall extending along the inner side of the top wall, the inner top wall having said stop member extending therefrom, said stop member being a tab extending substantially perpendicular to the top wall, the tab passing from an interior of the contact section past the plane of the top wall, whereby when forces are exerted against the tab, the tab engages the top wall such that substantially all of the forces against the tab are sheer forces, an integral contact termination section for termination with said wire, and an integral strain relief section for engaging said wire and preventing the transmission of a tensile force acting on said wire to said contact section; and a stuffer member adapted to be pressed into engagement with said housing, and is adapted for pressing said wire into electrical engagement with said contact termination section.

14. The electrical connector assembly of claim 13, wherein said stop member comprises a stop leg, and said contact section comprises an edge for engaging said stop member.

15. The electrical connector assembly of claim 14, wherein said stop leg is resiliently deflectable, and said housing includes a shoulder for engaging and thereby deflecting said stop leg into engagement with said contact section edge in response to said tensile force acting on said wire whereby a shearing force is imparted to said stop member.

16. The electrical connector assembly of claim 13, wherein said contact section comprises a pair of side walls, said side walls comprise shoulders for engaging said housing in response to said tensile forces acting on said wire.

17. The electrical connector assembly of claim 16, wherein said stop member is located between said shoulders.

18. The electrical connector assembly of claim 13, wherein said contact termination section includes a pair of insulation displacement blades.

19. The electrical connector assembly of claim 18, wherein a boot is formed on said contact termination section for guiding said wire to a position between said blades.

20. The electrical connector assembly of claim 13, wherein said contact section comprises an overstress member for preventing the overstress of said stop member.

* * * * *